United States Patent [19]

Derbyshire et al.

[11] 4,428,818

[45] Jan. 31, 1984

[54] LIQUEFACTION OF COAL

[75] Inventors: Frank J. Derbyshire, State College, Pa.; Darrell D. Whitehurst, Titusville, N.J.

[73] Assignee: Mobil Oil Corporation, New York, N.Y.

[21] Appl. No.: 447,594

[22] Filed: Dec. 7, 1982

[51] Int. Cl.[3] ..... C10G 1/00; C10G 1/06

[52] U.S. Cl. ..... 208/8 LE; 208/10; 208/8 R

[58] Field of Search ..... 208/8 R, 8 LE, 10

[56] References Cited

U.S. PATENT DOCUMENTS

| | | | |
|---|---|---|---|
| 4,045,187 | 8/1977 | Brink et al. | 208/8 LE |
| 4,097,361 | 6/1978 | Ashworth | 208/8 LE |
| 4,125,452 | 11/1978 | Effron | 208/8 LE |
| 4,277,326 | 7/1981 | Schlosberg et al. | 208/8 R |
| 4,277,327 | 7/1981 | Schlosberg et al. | 208/8 R |
| 4,298,453 | 11/1981 | Scheennagel et al. | 208/8 R |
| 4,306,960 | 12/1981 | Gliem | 208/8 LE |
| 4,319,981 | 3/1982 | Singuman | 208/8 R |

*Primary Examiner*—Delbert E. Gantz
*Assistant Examiner*—Helane E. Maull
*Attorney, Agent, or Firm*—Alexander J. McKillop; Michael G. Gilman; Van D. Harrison, Jr.

[57] ABSTRACT

Solvent refining of coal is conducted with a blend of coals calculated to maintain the phenols of the steady state recycle solvent within desired limits.

5 Claims, No Drawings

LIQUEFACTION OF COAL

FIELD OF THE INVENTION

This invention concerns improvements in solvent refining of coal whereby components of coal suitable for fuel are extracted from comminuted coal by a solvent and recovered as a low melting point mixture of reduced sulrur and mineral matter content adapted to use as fuel in conventional furnaces. In the type of operation to which the invention is directed, the solvent is derived from the product extract and applied to the raw coal feed.

BACKGROUND OF THE INVENTION

The present emphasis on the conversion of coal to substitute solid and liquid fuels has lead to several alternative processes which are now being considered. Among the many processes presently being considered is the solvent refining of coal (SRC) in which coal is treated at an elevated temperature in the presence of a hydrogen donor solvent and hydrogen gas in order to remove the mineral matter, to lower the sulfur content of the coal, and to convert it into a low melting solid which can be dissolved in simple lower boiling point organic solvents. This SRC can also be upgraded through catalytic hydrogenation to produce a liquid of higher quality. Such solvent refining of coal typifies liquefaction processes adapted to improvement by the technique of this invention.

Little is known at present as to the exact mechanism by which the coal is transformed into soluble form, or of the detailed chemical structure of the soluble form, or even the parent coal. It is known that many coals are easily solubilized and for others liquefaction is more difficult. Some correlations have been made between the rank of the coal and ease of liquefaction and product yield. A somewhat better correlation has been found with the petrography of the coal. Relatively little is known about the relationship to product quality.

The initially dissolved coal (SRC) may have utility as a substitute clean fuel or boiler fuel; however, for substitute fuels of a higher quality, specifications on viscosity, melting point, ash, hydrogen, nitrogen and sulfur contents are much more stringent. Attempts to meet these specifications by operating the SRC process more severely have met with many difficulties such as low liquid yields, high hydrogen consumption, difficulty of separating unreacted residue, and excessive char formation, which often completely plugs process transfer lines and reactors.

Alternative methods of improving specifications through catalytic hydrogenation are also difficult. The problems which arise are threefold: (1) SRC components are susceptible to further condensation and may deposit as coke on catalysts used for their conversion, (2) they can also foul the catalyst by physical blockage as their size approaches the pore size of conventional catalysts, and (3) they may contain metal contaminants, and their highly polar nature (particularly because of nitrogenous and sulfur components) can lead to selective chemisorption, and thus poison the catalysts.

The precise chemical nature of the SRC is still known, generally its composition is discussed in terms of solubility. Several classifications are commonly used. These include oils which are hexane or pentane soluble, asphaltenes which are benzene soluble and asphaltols which are pyridine soluble-benzene insoluble materials.

Of these the asphaltenes and asphaltols are believed to be responsible for high viscosity, solvent incompatability, and processing difficulties. Little is known about the asphaltols. It has been suggested that asphaltenes are derived from them; however, the nature of the reaction sequence has yet to be established.

In the process of converting coal to a low sulfur, low melting solid by use of recycled product fractions as solvent, several reaction steps occur. Generally coal is admixed with a suitable solvent recycle stream and hydrogen and the slurry is passed through a preheater to raise the reactants to a desired reaction temperature. For bituminous coal, the coal is substantially dissolved by the time it exits the preheater. Sub-bituminous coals can be dissolved but care must be exercised not to raise the temperature too high and thus promote charring. Exact reaction conditions and the nature of the intermediate product is, of course, affected by the solvent used.

The products exiting from the preheater are then transferred to a larger backmixed reactor where further conversion takes place to lower the heteroatom content of the dissolved coal to specification sulfur content and melting point. The linear velocity of the stream flowing through this reactor is controlled so that particulate matter of a desired size is retained in the reactor until about 40% of the reactor volume is filled. The reactor volume becomes filled (at steady state) up to about 40 vol % by solids which are produced from the coal. These solids have been shown to be catalytic for the removal of heteroatoms and the introduction of hydrogen into the coal products and solvent. The products exiting the reactor are initially separated by flash distillation to remove gases and light organic liquids. The products are further separated by filtration, centrifugation, solvent precipitation, etc.) and the filtrate is distilled to recover solvent range material (for recycle) and the final product SRC.

Properties of certain solvent components are important to the present invention. The recycle solvent derived in the process typically boils upward of about 400° F. and contains phenols and condensed ring aromatics as major components admixed with lesser amounts of many types of components including those having functional groups containing nitrogen, sulfur and the like. The phenol content may be and often is reduced by external catalytic hydrogenation over a relatively active hydrogenation catalyst such as cobalt-molybdenum on alumina. That operation also generates hydrogen donors useful in the process by hydrogenation of polycyclic aromatic components such as naphthalenes, phenanthrenes, pyrenes, etc., including the alkyl substituted polycyclics.

Phenols in the solvent are useful in the initial stages of the process because of their solvent power in promoting solutions of the coal components which contribute to the product, solvent refined coal. However, as the reaction proceeds, the formation of char appears to be promoted by excessive concentration of phenols in the solvent.

It will be understood that the term "phenols" is used herein as inclusive of all aromatic components having hydroxy groups attached to ring carbon atoms, including cresols, naphthols and ring substituted hydroxy aromatics of greater number of rings.

The inorganic minerals contained in the coal also influence the course of dissolution and reaction to produce solvent refined coal. The differences in such mineral content, generally reported as "ash", can have a marked effect on the course of the process. Pyrite in the coal acts as a mild hydrogenation catalyst to regenerate hydrogen donors from polycyclic aromatics compounds. The hydrogen donors provide for hydrogen transfer to coal components to promote the desired reactions.

SUMMARY OF THE INVENTION

It has now been found that a balance of solvent properties to promote higher yields of fuel product of improved quality can be achieved in steady state recycle solvents by using a blend of different coals as charge to the process in accordance with certain criteria described hereinbefore. The invention has particular impact in improving the processing of coals of high oxygen content, up to 20% by weight or more on a moisture as ash free basis. Such coals are often of the rank designated as "sub-bituminous". In essence, the blend is chosen on the basis of separate treatments of the two or more coals with a standard synthetic solvent and examination of the solubilized product of each coal for concentration of phenols. The ratios of solvent products which results in a solvent blend of less than 15% by weight of phenols preferably less than 10%, is chosen as the ratio in which the respective coals are blended.

Preferably, the blend of charge coals is also chosen to provide at least 1% by weight, preferably at least 3 weight percent, on a dry basis of pyrite. It has been found that pyrite catalyzes hydrogenation of the higher boiling condensed ring compounds such as purene, but has little or no effect on conversion of naphthalene to tetralin and substituted tetralins. It is found that hydrogenated pyrenes are more effective in hydrogen transfer reactions than is tetralin. In general, the ease of hydrogenation and the facility of hydrogen transfer reactions increases with increases in the number of the condensed rings in the hydrogen donor compound.

DESCRIPTION OF THE PREFERRED EMBODIMENTS

The invention provides a technique for improving quality of the recycle solvent in processing coals of high oxygen content, which alone yield recycle solvents of high phenol content, tending to result in formation of undersirable solid "char" in solvent refining of the coal. The sub-bituminous coals are often characterized by such high oxygen content and do produce recycle solvent of high phenol content. For example, Wyodak coal which is ranked as sub-bituminous, has an oxygen content in the neighborhood of 20 weight percent as compared with the bituminous Monterey coal of approximately 10 weight percent oxygen.

The solvent refining of coals typically proceeds by mixing finely divided coal with a recycle solvent constituted by a fraction boiling upwards of about 400° F. from the process effluence. The mixture is heated to a suitable temperature for dissolution and reaction, say 750–900° F., and reacted under hydrogen pressure. According to some variants of the process, the recycle solvent is hydrogenated over an active hydrogenation catalyst such as cobalt-molybdcnum or alumina. Hydrogenation generates hydrogen donors from condensed ring aromatics which serve to saturate coal fragments to a sufficient extent to inhibit polymerization reactions which can result in formation of char. Such catalytic hydrogenation also converts phenols to hydrocarbons to some extent. If sufficiently severe, this treatment can substantially eliminate phenols present in the recycle solvent.

During reaction for a suitable period of time under hydrogen pressure, hydrogen donors in the solvent direct the reaction by contributing hydrogen to highly reactive coal fragments. In the course of the reaction, hydrogen donors are regenerated by reaction with the hydrogen present in the reaction zone. It has been believed that certain of the coal minerals act as mild hydrogenation catalysts for such regeneration of hydrogen donors. It has been demonstrated that addition of finely divided pyrite improves the solvent refining yield, from which it is concluded that pyrite found in some coals are effective for regeneration of hydrogen donors.

It is now found that pyrite is relatively ineffective for regeneration of tetralins from naphthalenes but is increasingly effective for that purpose with respect to more highly condensed ring structure. Pyrene is easily hydrogenated and also donates hydrogen to other compounds from its hydrogenated form more readily than does tetralin. The behavior of phenanthrene is intermediate that of napthalene and pyrene.

Following reaction at elevated temperature under hydrogen pressure for a suitable period of time, from 3 minutes to 60 minutes, the liquid product is treated to remove solids including minerals and char, as by filtration, centrifuging, etc. The light gaseous products are flashed off for use as fuel or for hydrogen generation after removal of sulfur- and nitrogen-containing gases. The effluent, freed of solids and gaseous by-products is fractioned to provide a fraction-boiling above about 400° F., a suitable portion of which is recycled as solvent for incoming coal charge. The balance of the liquid effluent is taken as the product solvent refined coal for upgrading to specifications for liquid fuels, usually including catalytic hydrogenation for reduction of sulfur, oxygen and nitrogen content and increase in hydrogen content with resultant improvement in stability and other desirable properties. As previously noted, the recycle solvent may be subjected to catalytic hydrogenation, in whole or part.

Such processing of coals containing large amounts of oxygen, say 15 weight percent or more as in sub-bituminous coals, will result in a recycle solvent containing a large proportion of phenols which tend to promote formation of undesirable char. According to the present invention, such coals rich in oxygen compounds are blended with coals which produce lesser amounts of phenols in a proportion such that processing will yield a recycle solvent of acceptably low phenol content. It will be seen that an equivalent result may be obtained by external hydrogenation of a recycle solvent at sufficiently severe conditions to convert a substantial portion of the phenols to the corresponding single ring or condensed ring hydrocarbons and concurrently convert condensed ring compounds to hydrogen donors. The present invention makes it possible to eliminate or drastically reduce the severity of external hydrogenation. That external hydrogenation is an expensive step, requiring high cost active catalysts which become fouled and need frequent replacement in this service.

In view of the relative reactivities of different condensed ring compounds, external hydrogenation to generate hydrogen donors is an expensive way of supplying those agents, particularly when a cheap hydrogenation catalyst of low activity is present in the reactor. Such cheap catalysts may be introduced by the use of coal which is effective to generate hydrogen donors from compounds having three or more, preferably at least four, condensed rings, e.g. pyrene. Since tetralins, which are not generated to a substantial extent in the reactor, function at low efficiency as hydrogen donors, there is little justification for external hydrogenation to provide tetralins. Hydrogenated pyrene, on the other hand, transfers hydrogen quite readily and is generated at the conditions prevailing in the reactor in the presence of pyrites and the like.

For those, reasons, a preferred form of the invention contemplates a charge of blended coal which contains, as blended, a substantial proportion of pyrite, at least 1% by weight, preferably more than 3 weight percent. In this preferred form, the invention provides for a recycle solvent of reduced phenol content and containing the higher boiling condensed ring compounds which are easily hydrogenated. The preferred form also contemplates a blended coal charge which contains sufficient pyrite to supply the desired hydrogenation catalyst for generation in the reactor of hydrogen donors from compounds such as pyrene.

Calculation of the blend for pyrite content requires that the pyrite content of each coal be determined by standard methods. The relative proportions of different coals in the blend is a linear function of the pyrite content of each coal and the ratio of those coals in the blend.

In determining the coal blend for control of recycle solvent phenol content each coal is subjected to a batch test (without recycle of solvent) under conditions like those of solvent refining and the liquid product boiling above the minimum boiling point of recycle solvent is examined. for phenol content. The minumum boiling point chosen may vary depending on the particular operation or plant for which the determination is made, but will usually be in the neighborhood of 400° F. The solvent used in the batch test may be of any character which stimulates the solvent to be used in the process. However, a complex mixture such as a steady state recycle solvent introduces unnecessary complications to the determinations of phenols derived from the coal under test.

It is preferred to use a simple synthetic solvent such as 10% tetralin and 90% 2-methylnaphthalene which can be readily subtracted from total product of the batch test. A mixture of 3 parts by weight of such solvent with 1 part by weight of coal on a dry basis can be reacted at 840° F. for one hour under 1500 psi hydrogen pressure in an autoclave. The product of that reaction boiling above a desired cut-point (e.g. 400° F.) is examined to determine the percentage of phenols resulting from the reaction based on dry weight of the coal charged to the test.

The weight of phenols produced may be determined in various ways. One technique previously described for analysis of recycle solvents and solvent refined coal involves successive extractions with a series of selective solvents. A simple technique suited to the present purpose involves a single extraction with tetrahydrofuran. The extract is subjected to ion exchange chromatography to isolate phenols. A suitable ion exchange medium is a cross-linked polystyrene-divinylbenzene resin having quaternary ammonium functional groups, such as "Amberlyst A-26" in the hydroxide form. That resin will retain the phenols from the extract and the phenols can be eluted with tetrahydrofuran containing hydrogen chloride. This technique isolates the phenols which may then be further identified as boiling point fractions by distillation or gas chromatography.

From the knowledge of phenol yield from each coal, a blend ratio is then calculated to yield less than 15 weight percent, preferably less than 10 weight percent, of phenols based on dry weight of the blended coals. This results in an improved recycle solvent as compared with the low rank coal which yields a liquid product of higher phenol content. The solvent refined coal derived by use of the steady state recycle solvent from the blend will show improved yield and improved properties, particularly as regards susceptibility to upgrading by catalytic hydrogenation.

Typical steady state recycle solvents derived from different coals are shown in Table 1 as analyzed by a serious of extractions with specific solvents, designated SESC and described in detail in Chapter 6 of "The Nature and Origin of Asphaltenes in Processed" Electric Power Research Institute (EPRI-252, February 1976). Briefly stated the analysis involves successive elutions of the sample deposited on silica gel. The amount eluted by each solvent is determined and reported as percentage of the same weight charged. The successive solvents in order are:

1. Hexanes (mixed isomers)
2. Hexanes/15% Benzene
3. Chloroform
4. Chloroform/10% Diethyl Ether
5. Diethyl Ether/3% Ethanol
6. Methanol (absolute)
7. Chloroform/3% Ethanol
8. Tetrahydrofuran
9. Pyridine The major compounds in the fractions 1 and 2 so obtained are saturated hydrocarbons and aromatic hydrocarbons, respectively. Fraction 3 is primarily polar aromatics; non-basic nitrogen, oxygen and sulfur heterocyclics. The simple phenols are found in fraction 4. Fractions 5–9 are primarily multifunctional compounds, for example, the bulk of fraction 7 is polyphenols. The compounds leading to char and found in fractions 5–9.

The solvents shown in Table 1 were taken from steady recycle solvents in processing one sub-bituminous and 3 bituminous coals. Wyodak coal is sub-bituminous. The one Kentucky and two Illinois coals are ranked as bituminous. The coal designated "ILL6 BS" is also known as Burning Star; that designated "ILL 6 MT" is known as Monterey Coal.

TABLE I

SESC ANALYSES OF RECYCLE SOLVENTS

| Coal Fraction | Elution Solvent | Chemical Class of Major Compound Extracted | Wt. % Consumption | | | |
|---|---|---|---|---|---|---|
| | | | Wyodak | KY 14 | ILL6 BS | ILL6 MT |
| 1 | HEXANE | Saturated H/CLs and Aromatic H/Cs | 35.01 | 48.84 | 35.67 | 46.12 |
| 2 | HEX/BZ | Saturated H/CLs and Aromatic H/Cs | 15.95 | 21.44 | 27.07 | 21.78 |
| 3 | CLF | Polar Aromatics, non- | 8.48 | 6.60 | 6.40 | 8.05 |

TABLE I-continued

| SESC ANALYSES OF RECYCLE SOLVENTS | | | | | | |
|---|---|---|---|---|---|---|
| Coal Fraction | Elution Solvent | Chemical Class of Major Compound Extracted | Wt. % Consumption | | | |
| | | | Wyodak | KY 14 | ILL6 BS | ILL6 MT |
| | | basic, N, O Sheterocyclics | | | | |
| 4 | CLF/ET | Simple Phenols | 19.19 | 7.38 | 12.45 | 12.65 |
| 5 | ET/EOH | Multifunctional Compounds | 11.88 | 11.35 | 9.82 | 7.13 |
| 6 | MEOH | Multifunctional Compounds | 2.80 | 2.77 | 3.59 | 2.40 |
| 7 | CLF/OH | Polyphenols | 4.29 | .36 | .57 | .07 |
| 8 | THF | Multifunctional Compounds | 1.80 | 1.63 | 2.93 | 1.32 |
| 9 | PY | | .59 | | 1.51 | .48 |

What is claimed is:

1. In a process for solvent refining of a low rank coal of high oxygen content by mixing a comminuted coal charge with a hydrogen donor recycle solvent derived in the process maintaining the resultant mixture at reaction temperature in the presence of elemental hydrogen for a period of time sufficient to dissolve and react components of the coal, removing normally gaseous and solid materials from the effluent of said reaction, separating a liquid fraction boiling above about 400° F., recycling said liquid fraction to provide said hydrogen donor recycle solvent and recovering a liquid fuel product from the remainder of said effluent, the improvement for providing a hydrogen donor recycle solvent of greater benefit to the process which comprises separately subjecting said low rank coal and a coal of higher rank and lower oxygen content to test dissolution and reaction in admixture with a hydrogen donor solvent under hydrogen pressure at reaction temperature, analyzing the liquid products to determine the weight percent yield of phenols boiling above about 400° F., each of said reactions based on dry weight of the respective coals, calculating a blend ratio of the said coals which will yield less than 15 weight percent of phenols boiling above about 400° F. based on dry coal, adding to said low rank coal an amount of said coal of higher rank corresponding to said calculated blend ratio to provide a blended coal and supplying said blend coal to the process as said comminuted coal charge.

2. A process according to claim 1 wherein said blend ratio is calculated to yield less than 10 weight percent of phenols boiling above about 400° F.

3. A process according to claim 1 wherein the hydrogen donor solvent used in said test dissolution and reaction is a mixture of tetralin or alkyl substituted tetralin and naphthalene or alkyl substituted naphthalene.

4. A process according to claim 1 wherein the pyrite content of each of said coals is determined and the blend ratio is set to also provide at least 1 weight percent of pyrite in said comminuted coal charge based on dry weight of said charge.

5. A process according to claim 4 wherein the blend ratio is set to provide at least 3 weight percent of pyrite in said comminuted coal charge.

* * * * *